US005088733A

United States Patent [19]

Barnea et al.

[11] Patent Number: 5,088,733

[45] Date of Patent: Feb. 18, 1992

[54] BASEBALL BAT WITH OVAL HANDLE

[76] Inventors: Jeffrey M. Barnea, 2090 William, Palo Alto, Calif. 94306; Joseph A. Barnea, deceased, late of Manchester; by Catherine C. Barnea, administrator, 747 Lake Ave., both of Manchester, N.H. 03103

[21] Appl. No.: 176,711

[22] Filed: Apr. 1, 1988

[51] Int. Cl.[5] ..... A63B 59/06

[52] U.S. Cl. ..... 273/72 R; 273/72 A; 273/266

[58] Field of Search ..... 273/72, 73, 81 B, 81.4

[56] References Cited

U.S. PATENT DOCUMENTS

| | | | |
|---|---|---|---|
| D. 178,866 | 10/1956 | Cole | 273/72 R |
| 400,354 | 3/1889 | Morris | 273/72 R |
| 780,244 | 1/1905 | Truesdell | 273/72 |
| 2,944,820 | 7/1960 | Paullus | 273/72 R |
| 3,104,876 | 9/1963 | Salsinger | 273/72 R |
| 3,554,545 | 1/1971 | Mann et al. | 273/72 R |
| 4,505,479 | 3/1985 | Souders | 273/72 A |

FOREIGN PATENT DOCUMENTS

| | | | |
|---|---|---|---|
| 9232 | 4/1913 | United Kingdom | 273/81 B |
| 499895 | 1/1939 | United Kingdom | 273/81.4 |

OTHER PUBLICATIONS

Goldstein; Article taken from "NY Daily News"; 9/14/80; p. 8 of Sports Section.

*Primary Examiner*—Edward M. Coven
*Assistant Examiner*—Mark S. Graham
*Attorney, Agent, or Firm*—Paul Hentzel

[57] ABSTRACT

A baseball bat is provided with an oval handle to better fit the players grip and reduce breakage. Orientation of the grain relative to the major dimension of the oval permits compensation for rollover and rollunder swings.

3 Claims, 4 Drawing Sheets

BASEBALL BAT WITH OVAL HANDLE

TECHNICAL FIELD

This invention relates to baseball bats, and more particularly to such bats having an oval handle portion.

BACKGROUND

Heretofore baseball bats have been designed with many odd shapes and unusual configurations. U.S. Pat. No. 400,354 issued on Mar. 26, 1889 to Morris shows a bat with an oval barrel and a round handle. The major axis of the barrel oval was maintained vertically during the swing as to provide a broader hitting surface.

SUMMARY

It is therefore an object of this invention to provide an improved baseball bat with an oval handle.

It is another object of this invention to provide a such a bat which provides a more comfortable and natural grip for the batter's hands.

It is a further object of this invention to provide a such a bat which is less likely to turn in the batter's hands during a swing.

It is a further object of this invention to provide a such a bat which permits the batter to align his hands.

It is a further object of this invention to provide a such a bat which assists the batter to grip the bat in the identical each time at bat.

It is a further object of this invention to provide a such a bat which assists the batter in controlling of the orientation of the bat during a swing.

It is a further object of this invention to provide a such a bat assists the batter in maintaining a "horizontal" bat during the swing.

It is a further object of this invention to provide a such a bat which is less likely to break upon impact.

Briefly, these and other objects of the present invention are accomplished by providing a baseball bat to he held with the bottom hand positioned on the bat close to the batter and with the top hand positioned on the bat remote from to the batter. The bat has an elongated body with a small end and a large end and a center axis extending therethrough. The small end has a handle with a small oval cross-section traverse to the center axis. The handle has a major dimension and a minor dimension for defining a locked in position of the batter's hands relative to each other and relative to the bat. The large end has a barrel for striking the baseball. The barrel has a large round cross-section traverse to the center axis. A middle extends between the handle and the barrel, tapering in cross-section from the small oval cross-section of the handle to the large round cross-section of the barrel.

BRIEF DESCRIPTION OF THE DRAWING

Further objects and advantages of oval handle will become apparent from the following detailed description and drawing in which:

FIG. 2 A–F are cross-sectional views taken across the bat of FIG. 1;

Figure 1:
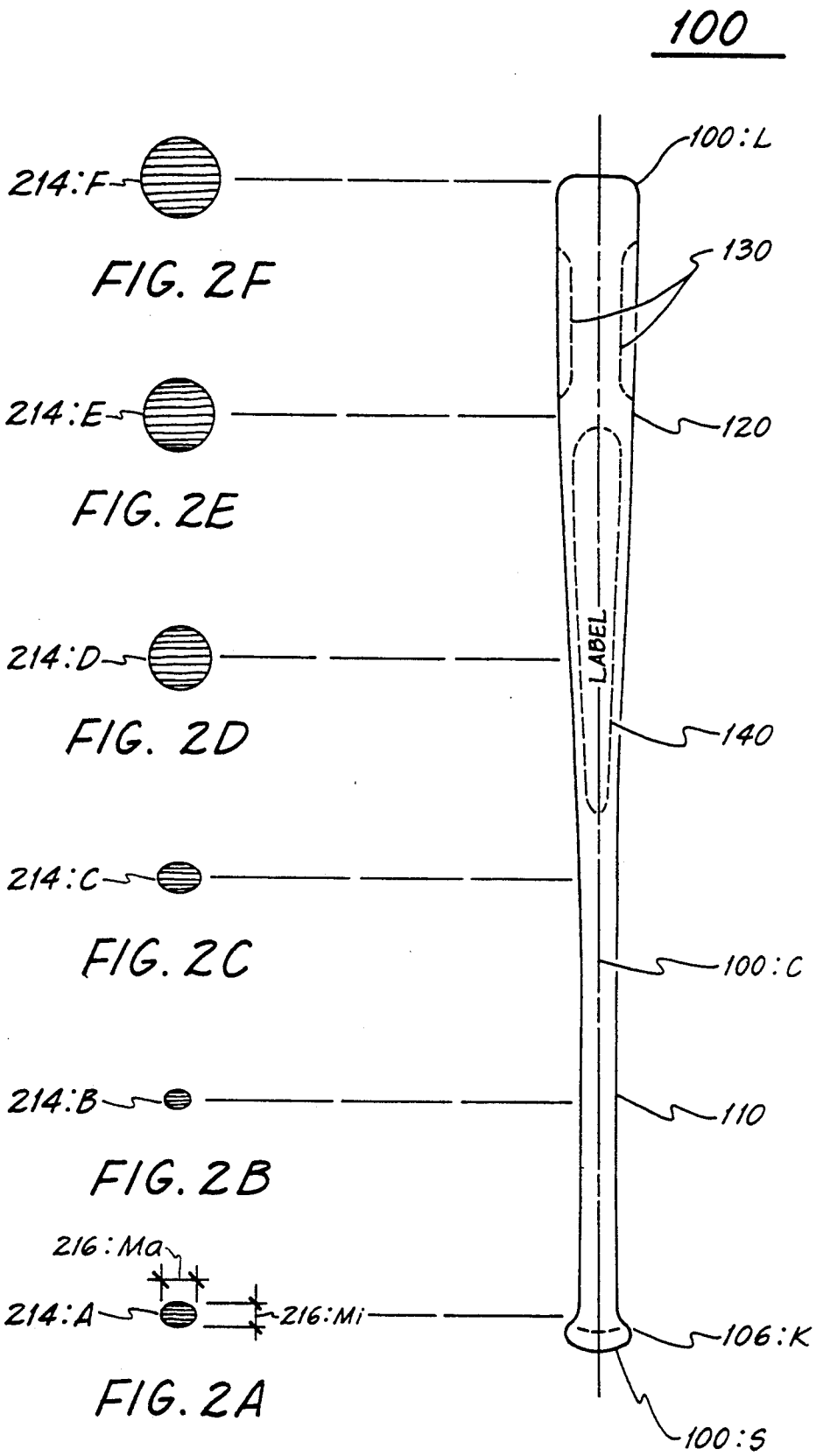
FIG. 1 is a plan view of a fully tapered baseball bat having a curvilinear elliptical handle.

Each element of the invention is designated by a three digit reference numeral. The first digit indicates the Figure in which the element is first disclosed or described. The second and third digits indicate like features and structural elements throughout the Figures. Some reference numerals are followed by a letter which indicates a sub-portion or feature of that element.

GENERAL CURVILINEAR HANDLE EMBODIMENT (FIG. 1–2)

Baseball bat 100 has a small end 100:S for holding the bat and a large end 100:L for striking the baseball, with a central axis 100:C extending therebetween. A knob type safety guard 106:K is provided at the small end to minimize "flying" bats hazards to the fans and players caused pre-release and slippage. Handle portion 110 located at the small end has an oval traverse cross-section 214:A (see FIG. 2A) with a major dimension 216:ma and a minor dimension 216:mi. Barrel portion 120 located at the large end has a round traverse cross-section 214:F (see FIG. 2F).

The oval cross-section of the handle becomes progressively round and larger toward the barrel as can be seen by comparing sequential cross-sections 214:A–F shown in FIG. 2A–2F. That is, the ratio of the major dimension to the minor dimension of each cross-section (Ma:Mi) is greatest at the small end, and gradually tapers down to 1 at the large end. Bat 100 is a full tapered embodiment of the oval handled bat.

BEST FIT

The oval cross-section of the handle provides a comfortable fit in the batter's hand. While gripping the bat, the batter can flex his hands around the handle until he feels the best fit of the oval in his palms and fingers. The embodiment of FIG. 1 shows a handle with a curvilinear cross-section. The curve around the cross-section continually changes direction. Each point of the curvilinear oval curve has a tangent extending in a slightly different direction to the tangents of the adjacent points. The continuous cure of the curvilinear handle may be provided by any suitably curved surface such as the elliptical cross-section shown in FIG. 1. Curvilinear surfaces with non-elliptical cross-sections may also be employed.

HAND ALIGNMENT

The best fit feature of the oval handle permits the batter to quickly locate his best grip each time at bat, for maintaining a constant alignment between his hands and the orientation of the bat. If the batter's grip is slightly off after initially picking up the bat, the batter flexes his hands and the bat shifts into the batter's standard position. As a result, the batter's forehand and backhand and the grain of the bat have the same grip relationship season after season. This consistent grip provided by the oval configuration eliminates at least one major variable in the development of batting skills, which is highly complex.

SWEET SPOT

The best (and strongest) hitting area 130 on a bat is referred to as the "sweet spot", and is located on the barrel edgewise to grain (see FIG. 1). The oval handle assists the batter in presenting the sweet spot to each pitched ball. The wood grain of the bat truns parallel with the central axis 100:C and also parallel with the major dimension 216:ma of the handle portion. The edge grain is therefore aligned with the oval handle. The wood displays its greatest stiffness along the edge. A sweet spot hit transfers more of the energy in the bat's swing to the hit ball producing higher velocity hits. In addition, the stiff grain at the sweet spot captures more of the pitched balls velocity into the return velocity of the hit. The stiffer the grain at impact, the more efficient is the energy transfer between the pitch and the hit.

BREAKAGE

The worst (and weakest) hitting region 140 on each bat is referred to as the "weak spot", and is located on the barrel broadside to the grain (see FIG. 1). The alternate layers of soft wood between the hard grain cushions the pitched ball on impact causing an inefficient energy transfer. The broadside grain orientation can withstand less ball impact then the edgewise grain of the sweet spot. Hits made off the weak spot is a major cause of bat breakage. However, the oval handle assists the batter in orienting the weak spot on the top or bottom of the swing and out of the way of the pitched ball.

Figure 3A:
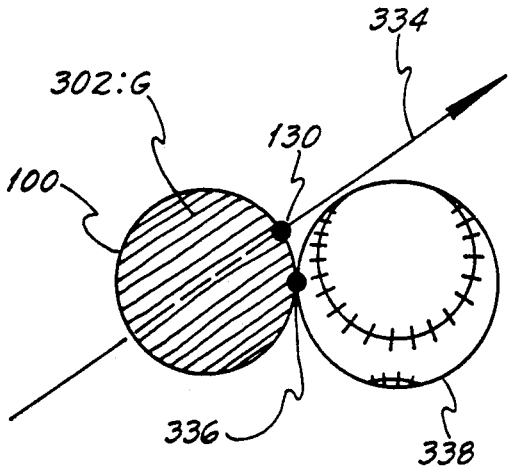
FIG. 3A is a diagram of a rollunder swing for a conventional bat showing the direction of the grain therein and the resulting displacement between the sweet spot and the point of ball impact.
Figure 3B:
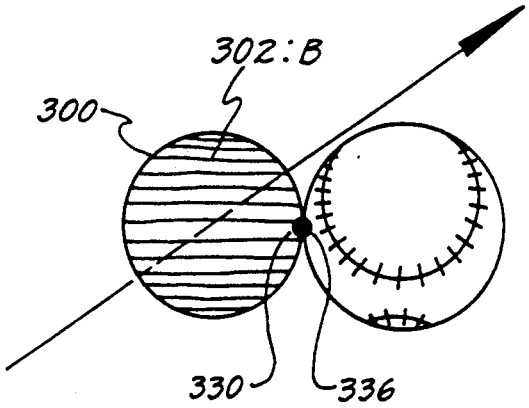
FIG. 3B is a diagram of a rollunder swing for a rollunder biased bat showing the downtilt of the grain therein and the resulting coincidence of the sweet spot with the point of ball impact.
Figure 4A:
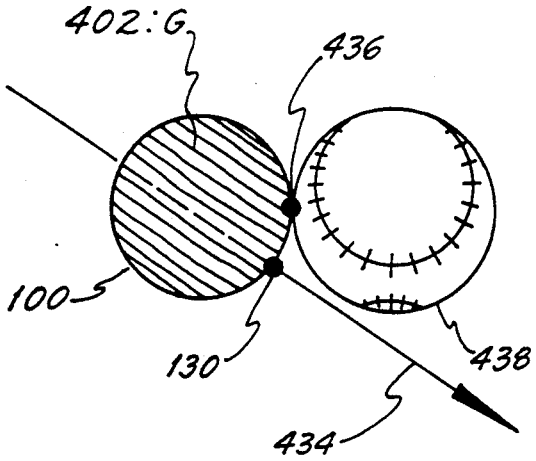
FIG. 4A is a diagram of a rollover swing for a conventional bat showing the direction of the grain therein and the resulting displacement between the sweet spot and the point of ball impact.
Figure 4B:
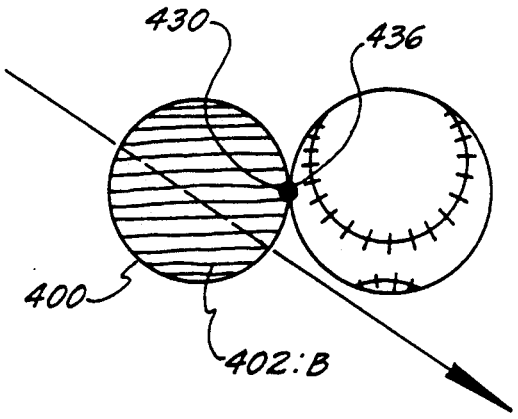
FIG. 4B is a diagram of a rollover swing for a rollover biased bat showing the uptilt of the grain therein and the resulting coincidence of the sweet spot with the point of ball impact.

ROLLOVER BAT EMBODIMENT (FIGS. 3 and 4)

The historically, the preferred batting swing is a horizontal bat swung along a level arc parallel to the ground over the plate. Occasionally a batter will develope a non-level or "roll" swing in which the bat has a "rollunder" (slight lift 334 see FIG. 3A) or a "rollover" (slight drop 434 see FIG. 4A). The deviations of the roll swing from the level affects the direction of the hit and imparts a slight spin to the ball; both of which may be used to advantage by the batter and the on-base runners.

However, a roll swing usually does not hit the ball directly on the edge grain sweet spot 130. The grain of the bat run parallel to the major dimension of the handle, and is tilted by the amount of roll in the swing. This tilt displaces the sweet spot away from the ball impact area. In rollunder swing 334 (see FIG. 3A) grain 302:G of bat 100 is tilted slightly upwards placing sweetspot 130 slightly above the preferred point of impact 336 with ball 338. In rollover swing 434 (see FIG. 4A) grain 402:G is tilted slightly downward placing sweetspot 130 slightly below the preferred point of impact 436 with ball 438. Roll hitters therefore get less than maximum energy transfer from their bats.

In order to accommodate roll hitters, special roll bats may be provided with the grain biased slightly off from the major oval dimension of the handle. Grain 302:B of rollunder biased bat 300 (see FIG. 3B) is tilted downward slightly from the major dimension of the handle, moving sweet spot 330 down to the preferred point of impact 336. Grain 402:B of rollover biased bat 400 (see FIG. 4B) is tilted upward slightly from the major dimension, moving sweet spot 430 up to the preferred point of impact 436.

Figure 5:
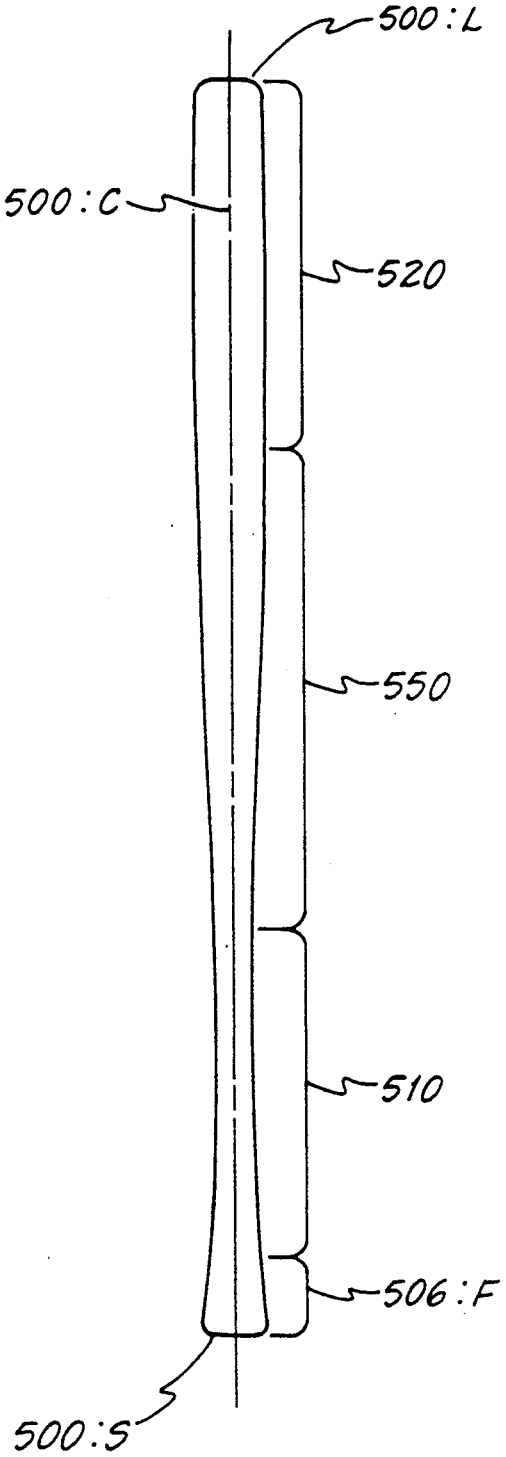
FIG. 5 is a plan view of a partially tapered baseball bat having an oblong non-curvilinear handle.

NON-CURVILINEAR EMBODIMENT (FIGS. 5 and 6)

Baseball bat 500 has a small handle end 500:S and a large barrel end 500:L, with a central axis 500:C. A flare type guard 506:F is provided at the small end. Handle portion 510 has an oblong traverse cross-section 614:A (see FIG. 6A) with a major dimension 616:ma and a minor dimension 616:mi. the handle cross-section is uniform throughout the length thereof as is shown by cross-sections 614:A and 614:B (see FIG. 6B). Handle 510 opposed flat sides 618:S defining spaced planes parallel with major dimension 614:ma. Flat sides 618:S form non-curvilinear segments of the traverse cross-sections of the handle.

Figure 6F:
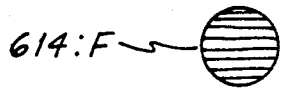
FIG. 6 A–F are cross-sectional views taken across the bat of FIG. 5.
Figure 6E:
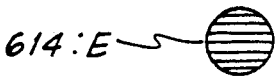
Figure 6D:
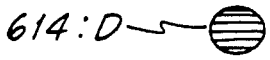
Figure 6C:
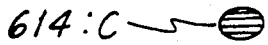
Figure 6B:
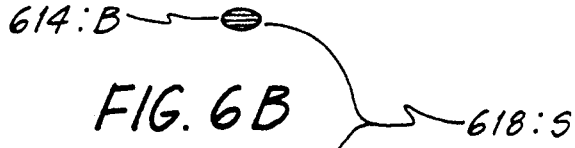
Figure 6A:
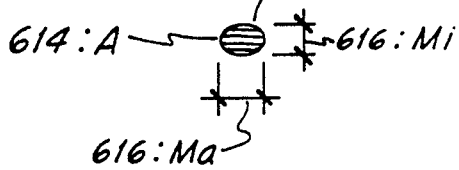

Barrel portion 520 is a right cylinder as is shown by round traverse cross-section 614:F (see FIG. 6F) and round traverse cross-section 614:E (see FIG. 6E). Middle portion 550 extends between oblong handle 510 and round barrel 520, and progressively tapers from small oblong to large round as is shown by cross-sections 614:C and 614:D (see FIG. 6C and 6D). Bat 500 is a partially tapered embodiment of the oval handled bat.

Figures 7, 8, 9:
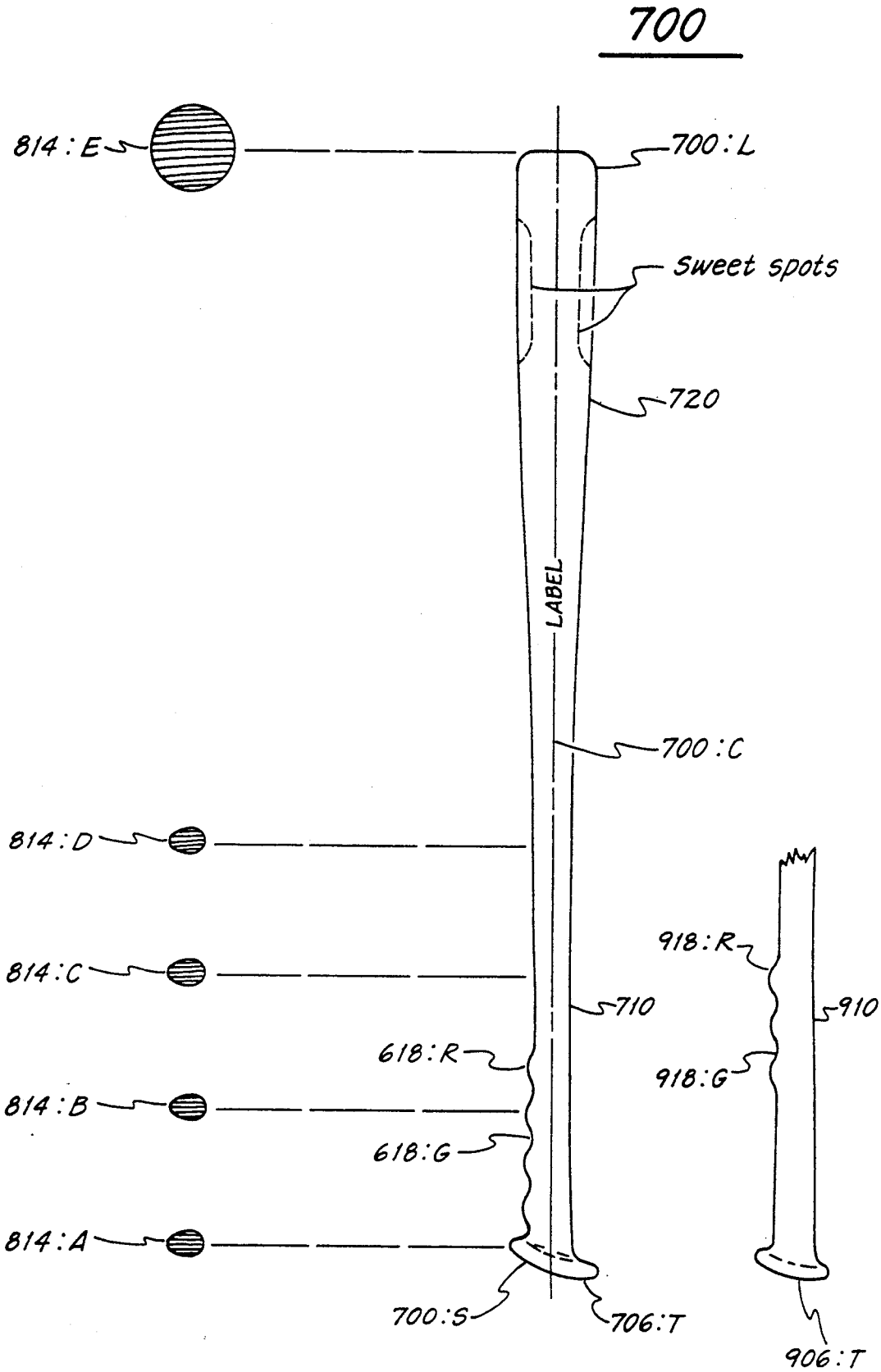
FIG. 7 is a plan view of a baseball bat having finger guides and an egg-shaped handle.
FIG. 8 A–F are cross-sectional views taken across the bat of FIG. 7.

FINGER GUIDE EMBODIMENT (FIGS. 7 and 8)

Baseball bat 700 has a small handle end 700:S and a large barrel end 700:L, with a central axis 700:C. A tilted guard 706;T is provided at the small end for engaging the palm and little finger of the batter's bottom hand. Handle portion 710 has an egg-shaped traverse cross-section 814:A (see FIG. 8A), and barrel portion 720 has a round traverse cross-section 814:E (see FIG. 8E).

Handle 710 has finger guides formed by spaced ridges 718:R with grooves 718:G therebetween for positioning the batter's fingers along the handle. The egg-shaped cross-section locates the batter's hands axially with respect the center axis 700:C, and the finger guides locate the batter's hand longitudinally along axis 700:C. The spacing of finger ridges 618:R are determined by the size of the batter's hands. The distance between adjacent ridges may be a fixed proportion of the overall length of the bat.

Finger guides may be provided for one hand only (see FIG. 9). Finger ridges 918:R and finger grooves 918:G are provided for the top hand only. The space on handle 910 near butt 906 is smooth permitting the batter to select is own hand position.

SPECIFIC EMBODIMENT

The following particulars of the oval handled baseball bat are given as an illustrative example.

Hard Ball Embodiment

Length: about 33 inches (84.48 cm)
Guard: Tilted Type
Handle: about 8 inches (21.12 cm)
Taper: continuous from handle to barrel end End: round Soft Ball Embodiment Length: about 33 inches (84.48 cm)
Guard: Flare Type
Handle: 8 inches (21.12 cm)
Taper: about 8 inches (21.12 cm)
Barrel: about 17 inches (43.52 cm) cylindrical
End: flat Little League Ball Embodiment Length: about 28 inches (71.68 cm)
Guard: Knob Type
Handle: about 7 inches (17.92 cm)
Taper: continuous from handle to barrel end
End: flat The dimensions and configurations given above are not intended as defining the limitations of the invention. Numerous other embodiments are possible.

INDUSTRIAL APPLICABILITY

It will be apparent to those skilled in the art that the objects of this invention have been achieved by providing an improved baseball bat with an oval handle which gives the batter a more comfortable and natural grip. The bat is less likely to turn in the batter's hands during a swing and permits the batter to align his hands relative to one another and relative to the grain of the bat. The horizontal orientation of the grain decreases the likelihood of breakage upon impact with the ball.

Clearly various changes may be made in the structure and embodiments shown herein without departing from the concept of the invention. For example, different types of guards may be employed with round and tapered barrels. Further, features of the embodiments shown in the various Figures may be employed with the embodiments of the other Figures.

Therefore, the scope of the invention is to be determined by the terminology of the following claims and the legal equivalents thereof.

We claim as our invention:

1. A baseball bat made of wood to he held by a batter with his bottom hand closely positioned on the bat relative to the batter's body and by his top hand remotely positioned on the bat relative to the batter's body, for striking a baseball, comprising:

an elongated body formed of a hard rigid material with a small end and a large end and a center axis extending therethrough;

an oval handle portion formed of the hard rigid body material at the small end thereof by which the batter grips the bat with his bottom hand and his top hand, the oval handle portion having a small oval cross-section traverse to the center axis formed by a major dimension and a minor dimension for defining a locked in position of the batter's bottom hand and top hand relative to each other and relative to the bat;

a round barrel portion formed of the hard rigid body material at the large end thereof for striking the baseball, the barrel portion having a large round cross-section traverse to the center axis;

a middle portion formed of the hard rigid body material extending between the oval handle portion and the barrel portion, which tapers in cross-section from the small oval cross-section of the oval handle portion to the large round cross-section of the barrel portion; and the grain of the wood extends through the bat from the oval handle portion to the barrel portion and is tilted from the major dimension of the oval handle portion.

2. The wooden baseball bat of claim 1, wherein the grain of the wood extending though the bat from the oval handle portion to the barrel portion is tilted downward from the major dimension of the oval handle portion to compensate for rollunder swinging of the batter.

3. The wooden baseball bat of claim 1, wherein the grain of the wood extending though the bat from the oval handle portion to the barrel portion is tilted upward from the major dimension of the oval handle portion to compensate for rollover swinging of the batter.

* * * * *